United States Patent [19]

Hayakawa et al.

[11] Patent Number: 4,971,878

[45] Date of Patent: Nov. 20, 1990

[54] AMORPHOUS SILICON PHOTOSENSITIVE MEMBER FOR USE IN ELECTROPHOTOGRAPHY

[75] Inventors: Takashi Hayakawa, Nara; Shiro Narikawa, Kashihara; Kunio Ohashi, Nara, all of Japan

[73] Assignee: Sharp Kabushiki Kaisha, Osaka, Japan

[21] Appl. No.: 332,775

[22] Filed: Apr. 3, 1989

[30] Foreign Application Priority Data

| | | | |
|---|---|---|---|
| Apr. 4, 1988 | [JP] | Japan | 63-82450 |
| Apr. 28, 1988 | [JP] | Japan | 63-107098 |
| Jun. 30, 1988 | [JP] | Japan | 63-164478 |

[51] Int. Cl.[5] ..... G03G 5/028

[52] U.S. Cl. ..... 430/84; 430/130

[58] Field of Search ..... 430/84, 95, 136

[56] References Cited

U.S. PATENT DOCUMENTS

| | | | |
|---|---|---|---|
| 4,217,374 | 8/1980 | Oushinsky et al. | 430/84 |
| 4,265,991 | 5/1981 | Hirai et al. | 430/84 |
| 4,532,199 | 7/1985 | Ueno et al. | 430/84 |
| 4,613,558 | 9/1986 | Nakagawa et al. | 430/84 |
| 4,683,186 | 7/1987 | Ohashi et al. | 430/84 |

FOREIGN PATENT DOCUMENTS

| | | |
|---|---|---|
| 57-158650 | 9/1982 | Japan . |
| 60-35059 | 2/1985 | Japan . |

OTHER PUBLICATIONS

M. H. Brodsky et al., *Appl. Phys. Lett.*, (1977), 30:561-563.

H. Fritzsche, *Localized States and Doping in Amorphous Semiconductor*, "Proceedings of the Seventh International Conference on Amorphous and Liquid Semiconductors", (1977, W. E. Spear, Ed.).

*Primary Examiner*—John L. Goodrow

*Attorney, Agent, or Firm*—Irell & Manella

[57] ABSTRACT

An electrophotographic photosensitive member is disclosed which comprises an electrically conductive substrate and a photoconductive layer formed on said substrate, wherein the photoconductive layer is made of amorphous silicon containing 40 atomic % or more of hydrogen and/or halogen.

8 Claims, 6 Drawing Sheets

AMORPHOUS SILICON PHOTOSENSITIVE MEMBER FOR USE IN ELECTROPHOTOGRAPHY

BACKGROUND OF THE INVENTION

1. Field of the Invention

This invention relates to an electrophotographic photosensitive member comprising a photoconductive layer made of amorphous silicon which is formed by an electron cyclotron resonance method.

2. Description of the Prior Art

In recent years, as an electrophotographic photosensitive member which is used, for example, in an apparatus for forming images based on electrophotography, there has been proposed a photosensitive member in which a photoconductive layer made of amorphous silicon (referred to as a-Si hereinafter) is formed on a conductive substrate. This a-Si type photosensitive member has numerous advantages such as its long working life, high photosensitivity, high degree of hardness (Hv: 1500–2000 kg/mm$^2$), and harmlessness to human bodies. Thus, many attempts have been made to put it into practical use as a desirable photosensitive material.

Conventional a-Si type photosensitive members have usually been produced by plasma CVD, sputtering, or other techniques. In the plasma CVD method, a source gas such as monosilane or disilane is first introduced into a vacuum chamber in which a conductive substrate made of aluminum or the like is disposed. The introduction of the source gas into the vacuum chamber is followed by glow discharge with the application of high-frequency power, so that the source gas in the vacuum chamber is decomposed and an a-Si layer containing hydrogen is grown on the substrate. In the sputtering method, which employs a Si wafer as a target, both $H_2$ gas and a rare gas such as Ar, He, or the like are first introduced into a chamber, and then glow discharge is caused by the application of highfrequency power, so that the target is sputtered and an a-Si layer containing hydrogen is grown on a substrate.

However, to confer sufficient photosensitivity to the a-Si type photosensitive member in the production processes mentioned above, the conductive substrate must be heated to form the a-Si layer thereon. Consequently, the amount of hydrogen contained in the a-Si layer is increased. The excessive amount of hydrogen contained in the a-Si layer makes its electric conductivity as high as $10^{-10}$ s/cm, so that the electric-charge retaining property of the a-Si layer is deteriorated.

The electric conductivity of the a-Si layer can be increased by the addition of boron thereto with the use of, for example, $B_2H_6$ gas. In this case, however, the degree of increase is relatively small and there can only be obtained the electric conductivity of at most about $10^{-11}$–$10^{-12}$ s/cm.

The conventional production processes are also disadvantageous in that the deposition rate is very low; the availability of source gas is low; and plenty of powdered polymer such as $(SiH_2)_n$ is produced as a by-product and deposited on the surface of the conductive substrate during the growth of a-Si layer, so that many defects can be generated in the a-Si layer, resulting in reduced production yield of a-Si type photosensitive members.

For the conventional a-Si type photosensitive members, the amount of hydrogen contained in the a-Si layer is strictly limited to the range of 10–40 atomic %. (See Japanese Patent Publication No. 60-35059 and U.S. Pat. No. 4,265,991.) Moreover, Japanese Laid-open Patent Publication No. 57-158650 discloses an a-Si layer containing 10–40 atomic % of hydrogen, in which the ratio of the absorption coefficient $\alpha(SiH_2)$ at around 2100 cm$^{-1}$ to the absorption coefficient $\alpha(SiH)$ at around 2000 cm$^{-1}$ in the infrared spectrum of the a-Si layer is in the range of about 0.2–1.7. The absorption coefficient $\alpha(SiH_2)$ at around 2100 cm$^{-1}$ is due to Si-$H_2$ bonds, and the absorption coefficient $\alpha(SiH)$ at around 2000 cm$^{-1}$ is due to Si-H bonds. To ensure sufficient photosensitivity for the electrophotographic photosensitive members comprising an a-Si photoconductive layer, their resistivity becomes as small as $10^9$ Ω.cm, and even when boron (B) is doped in the a-Si layer, their resistivity is still as small as $10^{11}$ Ω.cm, so that the electric-charge retaining property of the a-Si type photosensitive members is inferior to that of conventional selenium or organic photosensitive members.

To improve the electric-charge retaining property of the conventional a-Si photosensitive members, it is necessary to increase the absorption coefficient ratio $\alpha(SiH_2)/\alpha(SiH)$. However, in the processes by plasma CVD or sputtering, the reaction of the source gas becomes more active with the increase in high-frequency power in forming each layer, so that a lot of powdered polymer such as $(SiH_2)_n$ is produced. The resulting powdered polymer is deposited on the surface of the substrate of the photosensitive member, which impairs the quality of the photosensitive member obtained.

SUMMARY OF THE INVENTION

The electrophotographic photosensitive member of the invention, which overcomes the above-discussed and numerous other disadvantages and deficiencies of the prior art, comprises an electrophotographic photosensitive member comprising an electrically conductive substrate and a photoconductive layer formed on the substrate, wherein the photoconductive layer is made of amorphous silicon containing 40 atomic % or more of hydrogen and/or halogen.

In a preferred embodiment, the photosensitive layer is made of amorphous silicon containing 40 to 60 atomic % of hydrogen and/or halogen.

In a more preferred embodiment, the photosensitive layer is made of amorphous silicon containing 40 to 50 atomic % of hydrogen and/or halogen.

In a preferred embodiment, the ratio of the absorption coefficient at around 2,100 cm$^{-1}$ to the absorption coefficient at around 2,000 cm$^{-1}$ of the amorphous silicon is in the range of from 1.3 to 2.5.

In a preferred embodiment, the ratio of the integrated absorption intensity at around 840 cm$^{-1}$ to the integrated absorption intensity at around 880 cm$^{-1}$ in the infrared spectrum of the amorphous silicon is in the range of from 0.2 to 0.6.

In a preferred embodiment, the electrophotographic photosensitive member of this invention further comprises an intermediate layer interposed between the substrate and the photoconductive layer and an outer coating layer formed on the photoconductive layer.

In a preferred embodiment, the photoconductive layer is doped with an element of Group IIIA of the Periodic Table as an impurity.

In a preferred embodiment, the photoconductive layer is doped with an element of Group VA or Group VIA of the Periodic Table as an impurity.

In a preferred embodiment, the photoconductive layer is formed by an electron cyclotron resonance method.

Thus, the invention described herein makes possible the objectives of (1) providing an electrophotographic photosensitive member which has high photosensitivity and extremely high dark resistivity, so that its excellent electric-charge retaining property can be attained, resulting in an image of high quality; (2) providing an electrophotographic photosensitive member which has improved electric conductivity and electric-charge retaining property, so that an image of high quality can be obtained; (3) providing an electrophotographic photosensitive member which is produced by the electron cyclotron resonance method, so that the deposition rate and gas availability can be improved, resulting in reduced production cost; and (4) providing an electrophotographic photosensitive member which is produced by the electron cyclotron resonance method, so that the production of powdered polymer such as $(SiH_2)_n$ can be prevented, resulting in improved production yield.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
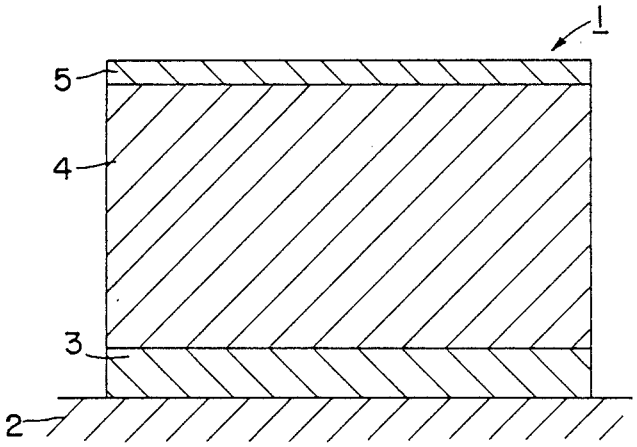
FIG. 1 is a cross sectional view showing the structure of an electrophotographic photosensitive member of this invention.
Figure 2:
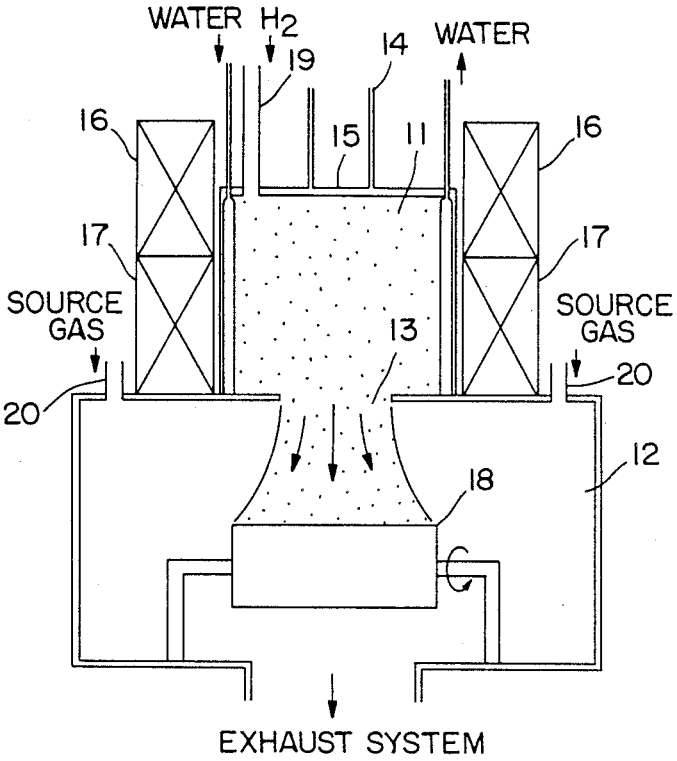
FIG. 2 is a cross sectional view showing an apparatus for the production of the electrophotographic photosensitive member of this invention by an electron cyclotron resonance method.
Figure 3:
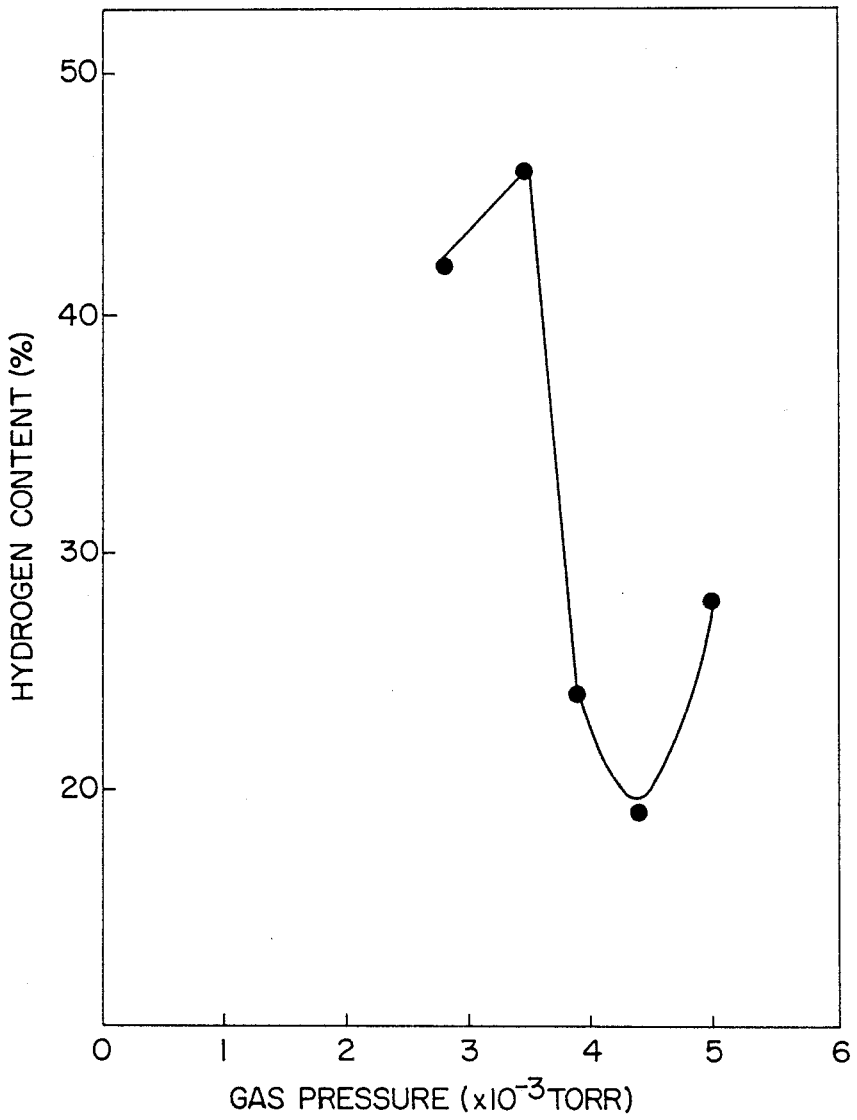
FIG. 3 shows the relationship between the pressure of gas and the hydrogen content in the a-Si layers of various electrophotographic photosensitive members.

FIG. 1 is a cross sectional view showing the structure of an electrophotographic photosensitive member of this invention. FIG. 2 is a cross sectional view of an apparatus for forming the layers of the electrophotographic photosensitive member shown in FIG. 1 by the electron cyclotron resonance method.

In FIG. 2, the apparatus comprises a plasma formation chamber 11 in which hydrogen plasma is formed and a deposition chamber 12 in which each layer is formed. The plasma formation chamber 11 and the deposition chamber 12, which communicate with each other via a plasma inlet 13, are evacuated with an exhaust system (not shown) comprising an oil diffusion pump and an oil rotary pump.

The plasma formation chamber 11 serves as a cavity resonator into which 2.45-GHz microwaves are introduced through a waveguide 14. A microwave supply window 15 is made of a quartz glass plate which can transmit the microwaves. The plasma formation chamber 11 is provided with a gas supply pipe 19 through which hydrogen gas can be introduced thereinto. Magnetic coils 16 and 17 are disposed around the plasma formation chamber 11. The magnetic coil 16 generates a magnetic field (875G) for the formation of plasma and the magnetic coil 17 generates a magnetic field by which the plasma formed in the plasma formation chamber 11 is introduced into the deposition chamber 12.

The electrophotographic photosensitive member of this invention is produced with this apparatus as follows: First, a conductive substrate 18 is positioned nearly in the central portion of the deposition chamber 12. The conductive substrate 18 can be, for example, a drum made of aluminum. The plasma formation chamber 11 and the deposition chamber 12 are evacuated with the exhaust system. Then, hydrogen gas and, if required, additional gas are introduced into the plasma formation chamber 11 through the gas supply pipe 19, while source gas is introduced into the deposition chamber 12 through gas supply pipes 20. The source gas can be a gas of silicon compounds such as $SiH_4$, $Si_2H_6$, $SiF_4$, $SiCl_4$, $SiHCl_3$, and $SiH_2Cl_2$, or a mixture thereof. When an a-SiC or a-SiN layer is formed, for example, $CH_4$ or NO gas is added to the source gas. In this case, the pressure of gas is controlled to be in the order of $10^{-3}$–$10^{-4}$ Torr. Then, the microwaves generated from a microwave oscillator (not shown) are introduced into the plasma formation chamber 11, while the magnetic field is being formed. The hydrogen gas is converted into plasma in the plasma formation chamber 11, and the resulting hydrogen plasma is introduced into the deposition chamber 12 through the plasma inlet 13, to convert the source gas into plasma there. The resulting plasma of the source gas is then brought onto the conductive substrate 18 by the magnetic field for the introduction of plasma, and a-Si is deposited on the surface of the conductive substrate 18. Because the conductive substrate 18 is being rotated by a supporting member, a layer (e.g., an a-Si layer) having a uniform thickness can be formed on the surface of the conductive substrate 18. The uniformity of the thickness of the layer can be further improved by regulating the position and size of the plasma inlet 13.

As is similar to the case of the conventional plasma CVD, the conductivity type of the a-Si layer formed can be determined by the sort of additional gas to be introduced. When the additional gas of a compound containing an element of Group IIIA of the Periodic Table such as $B_2H_6$ or $BH_3$ is used, the a-Si layer of p-type is obtained. On the contrary, when the additional gas of a compound containing an element of Group VA or Group VIA of the Periodic Table such as $PH_3$, $PCl_3$, or $PCl_5$ is used, the a-Si layer of n-type is obtained.

With this apparatus, a series of experiments for forming a-Si layers were conducted using the source gas of $SiH_4$ under the different pressures of gas. The dependences of the hydrogen content, absorption coefficient ratio $\alpha(SiH_2)/\alpha(SiH)$, photo conductivity ($\eta.\mu.\tau$), and dark resistivity ($\rho\delta$) of these a-Si layers upon the pressure of gas are respectively shown in FIGS. 3, 4, 5, and 6.

As can be seen from these figures, when 40 atomic % or more of hydrogen was contained in the a-Si layer and the absorption coefficient ratio $\alpha(SiH_2)/\alpha(SiH)$ was in the range of 1.3–2.5, the a-Si layer having dark resistivity of $10^{12}\phi$. cm or more and high photo conductivity (i.e., high photosensitivity) was obtained. It is noted that the conventional a-Si layers containing 40 atomic % or less of hydrogen and having the ratio $\alpha(SiH_2)/\alpha(SiH)$ in the range of 0.2–1.7 could not have attained dark resistivity of $10^{12}\phi$. cm or more and high photo conductivity (i.e., high photosensitivity). Preferably, the amount of hydrogen contained in the a-Si layer is 40–60 atomic %, and more preferably 40–50 atomic %. When the amount of hydrogen contained in the a-Si layer is greater than 60 atomic %, the optical band gap of the a-Si layer becomes excessively large, so that the layer is not suitable for the photoconductive layer of the electrophotographic photosensitive member which must have photosensitivity to visible light.

In general, the absorption peak due to Si-H bonds is observed at around 2000 $cm^{-1}$ and the absorption peak due to Si-$H_2$ bonds is observed at around 800–900 $cm^{-1}$ in the infrared spectrum of a-Si. When $SiH_2$ is present in the form of a monomer, its absorption peak is observed only at around 880 $cm^{-1}$ and when $SiH_2$ is present in the form of a polymer such as $(SiH_2)_n$, its absorption peaks are observed both at around 880 $cm^{-1}$ and at around 840 $cm^{-1}$ in the infrared spectrum of a-Si.

As for the a-Si layer of the electrophotographic photosensitive member, $SiH_2$ and $(SiH_2)_n$ are present as a mixture, and it is well known that the properties of the photosensitive member such as electric conductivity can vary depending on the ratio of $(SiH_2)_n$ to $SiH_2$. The inventors have found that the ratio of $(SiH_2)_n$ to $SiH_2$ can be estimated on the basis of the $I_2$ (the integrated absorption intensity at around 840 $cm^{-1}$)/$I_1$ (the integrated absorption intensity at around 880 $cm^{-1}$) ratio in the infrared spectrum of a-Si. The integrated absorption intensity is expressed by the integral $\int\alpha(w)/w.dw$ where $\alpha$ (w) is the absorption coefficient at the wave number of w. If the ratio is nearly set to satisfy the inequality $0.2<(I_2/I_1)<0.6$, it is possible to improve the properties of the a-Si type photosensitive member such as electric conductivity.

Figure 7:
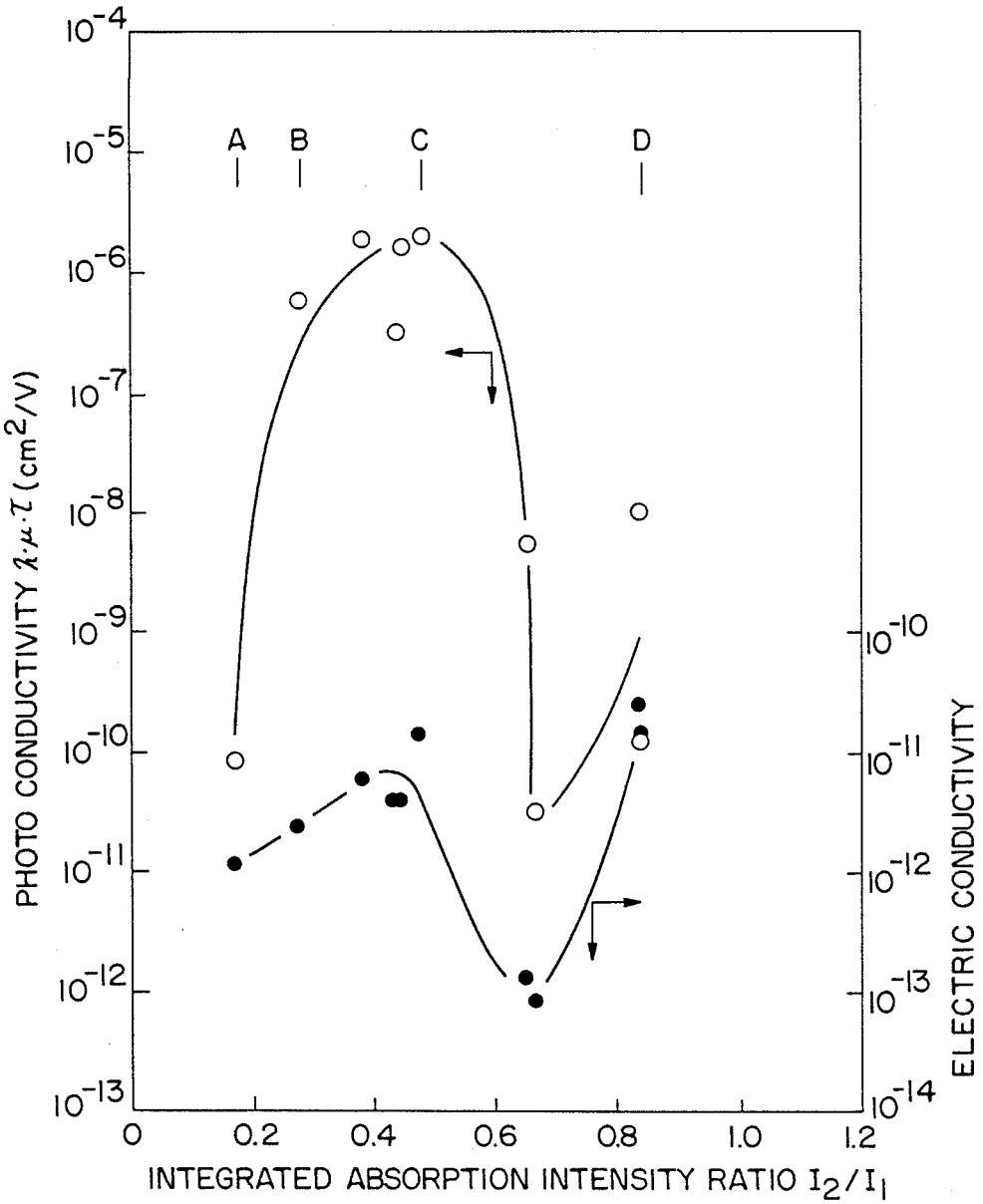
FIG. 7 shows the relationship between the integrated absorption intensity ratio ($I_2/I_1$) and the electric conductivity and the relationship between the integrated absorption intensity ratio ($I_2/I_1$) and the photo conductivity ($\eta.\mu.\tau$) of the a-Si layers of various electrophotographic photosensitive members.

FIG. 7 shows the relationship between the integrated absorption intensity ratio ($I_2/I_1$) and the electric conductivity and the relationship between the integrated absorption intensity ratio ($I_2/I_1$) and photo conductivity. When the integrated absorption intensity ratio ($I_2/I_1$) is in the range of about 0.2–0.6, the electric conductivity is about $10^{-12}$ s/cm and the photo conductivity is about $10^{-6}$ $cm^2/V$, both of which are satisfactory.

The a-Si layer formed by the electron cyclotron resonance method is advantageous in that: (1) Stable plasma can be produced under relatively low pressure of gas ($10^{-5}$–$10^{-3}$ Torr) and the production of powdered polymer such as $(SiH_2)_n$ be avoided by preventing the secondary reaction between the reactants, so that the a-Si layer which is satisfactory can be formed; (2) Because of the high energy of electrons, the efficiencies of decomposition, excitation, and ionization of the introduced gas are remarkably improved. As a result, both the deposition rate and gas availability are increased by 6–10 times. For example, it is possible to attain the deposition rate of about 23 μm/hr and the gas availability of about 49%; and (3) Because of the appropriate degree of ion impingement, it is possible to form the a-Si layer without heating the conductive substrate, so that the amount of $(SiH_2)_n$ contained in the a-Si layer can be reduced, resulting in a high-quality a-Si layer with high photosensitivity.

The a-Si layer of this invention is suitable for the photosensitive element of a device by which optical information from outside can be converted into electrical signals, so that it can serve as the photoconductive layer of an electrophotographic photosensitive member, the photosensitive element of an image sensor, or the photosensitive element of a liquid crystal or multilayer display device. Moreover, the a-Si layer of this invention can also be applied to various devices such as solar batteries and thin film transistors.

EXAMPLE 1

In this example, an electrophotographic photosensitive member 1 to be positively charged as shown in FIG. 1 was produced as follows: On a conductive substrate 2, an intermediate layer 3 made of a-Si in which a large amount of boron was doped, a photoconductive layer 4 made of a-Si in which a small amount of boron was doped, and an outer coating layer 5 made of a-SiC were successively formed in that order by the electron cyclotron resonance method. As an additional gas for doping boron in the a-Si layers, a compound of boron with hydrogen or halogen such as $B_2H_6$ is preferred. In place of boron, an element of Group IIIA of the Periodic Table such as aluminum, gallium, indium, or the like can be used. The conditions for the production of respective layers are shown in Table 1 below.

TABLE 1

| Layer | MW power (kW) | Flow rate $SiH_4$ (SCCM) | Flow rate $B_2H_6$ (SCCM) | $CH_4$ (SLM) | Gas pressure ($\times 10^{-3}$ Torr) |
|---|---|---|---|---|---|
| Intermediate | 2.5 | 120 | 30*1 | — | 2.8 |
| Photoconductive | 2.5 | 120 | 5*2 | — | 2.8 |
| Outer coating | 2.5 | 30 | — | 2.0 | 2.8 |

*1: 3000 ppm in $H_2$.
*2: 30 ppm in $H_2$.

The a-Si photoconductive layer 4 contained 48 atomic % of hydrogen, and its absorption coefficient ratio $\alpha(SiH_2)/\alpha(SiH)$ in the infrared spectrum was 2.15.

In this example, powdered polymer such as $(SiH_2)_n$ was not produced, and both the deposition rate and the gas availability were increased 6–10 times compared with that of the conventional processes. Moreover, when the resulting a-Si type photosensitive member was examined for its properties, its electriccharge retaining property was particularly excellent compared with the conventional a-Si type photosensitive members. When the a-Si type photosensitive member was used in a commercial copying machine to carry out copying, images of high quality were obtained.

When an a-SiN layer or a-SiO layer formed by the electron cyclotron resonance method was used as the outer coating layer 5 instead of the a-SiC layer, the results obtained were also satisfactory.

EXAMPLE 2

An electrophotographic photosensitive member 1 as shown in FIG. 1 was produced in a similar manner to that of Example 1, except that different gas pressures were used to form the photoconductive layer 4. The resulting photosensitive members were examined for their electric charge retaining property and photosensitivity. The results obtained are shown in Table 2.

TABLE 2

| Sample No. | 1 | 2 | 3 | 4 | 5 |
|---|---|---|---|---|---|
| Gas pressure ($\times 10^{-3}$ Torr) | 2.8 | 3.4 | 3.8 | 4.4 | 5.0 |
| Electric charge retaining property* | ◎ | ◎ | ○ | Δ | Δ |
| Photo-sensitivity* | ◎ | ◎ | X | X | X |

* ◎ Very good
◎ Good
Δ Acceptable for practical use
X Poor

Figure 4:
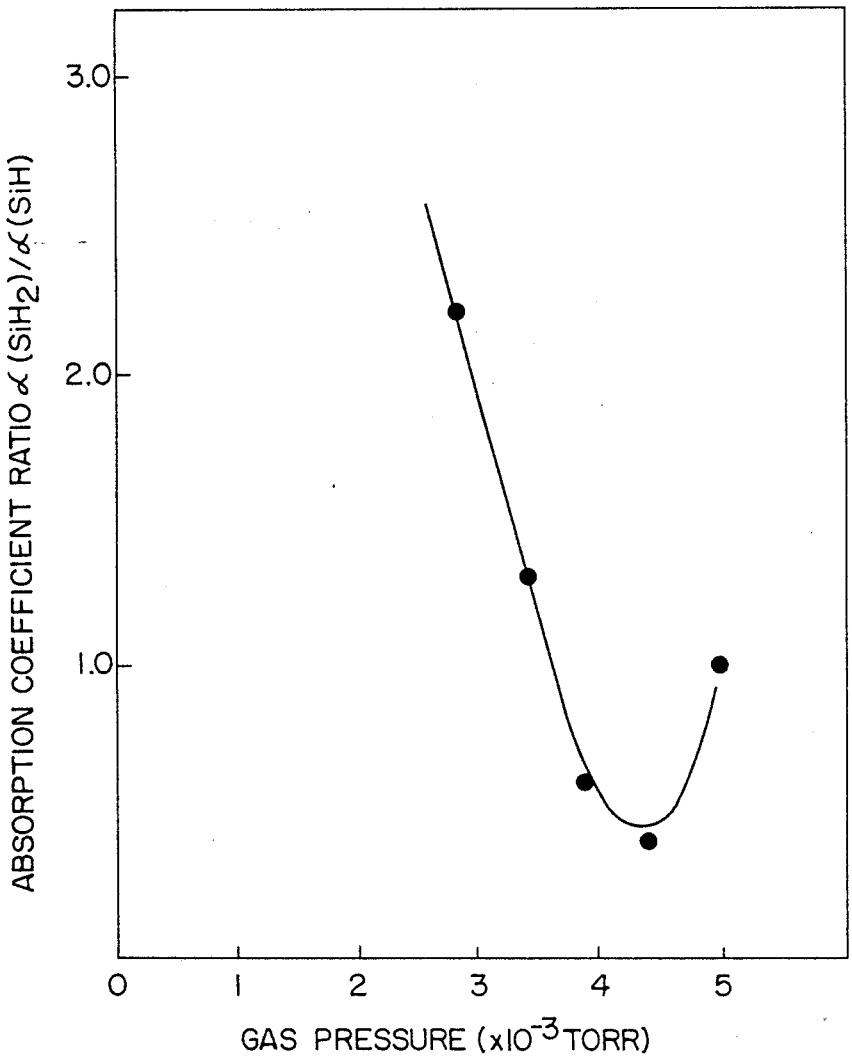
FIG. 4 shows the relationship between the pressure of gas and the absorption coefficient ratio $\alpha(SiH_2)/\alpha(SiH)$ of the a-Si layers of various electrophotographic photosensitive members.
Figure 5:
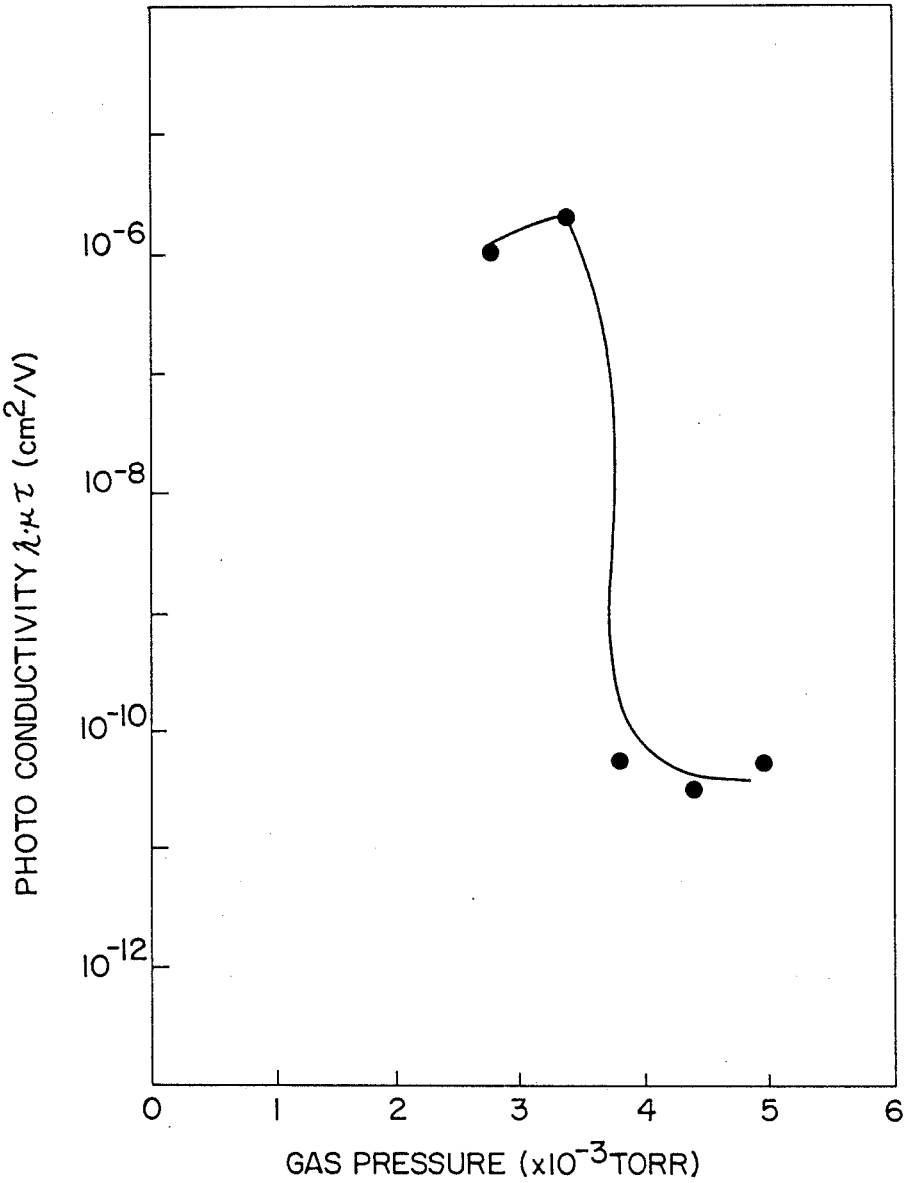
FIG. 5 shows the relationship between the pressure of gas and the photo conductivity ($\eta.\mu.\tau$) of the a-Si layers of various electrophotographic photosensitive members.
Figure 6:
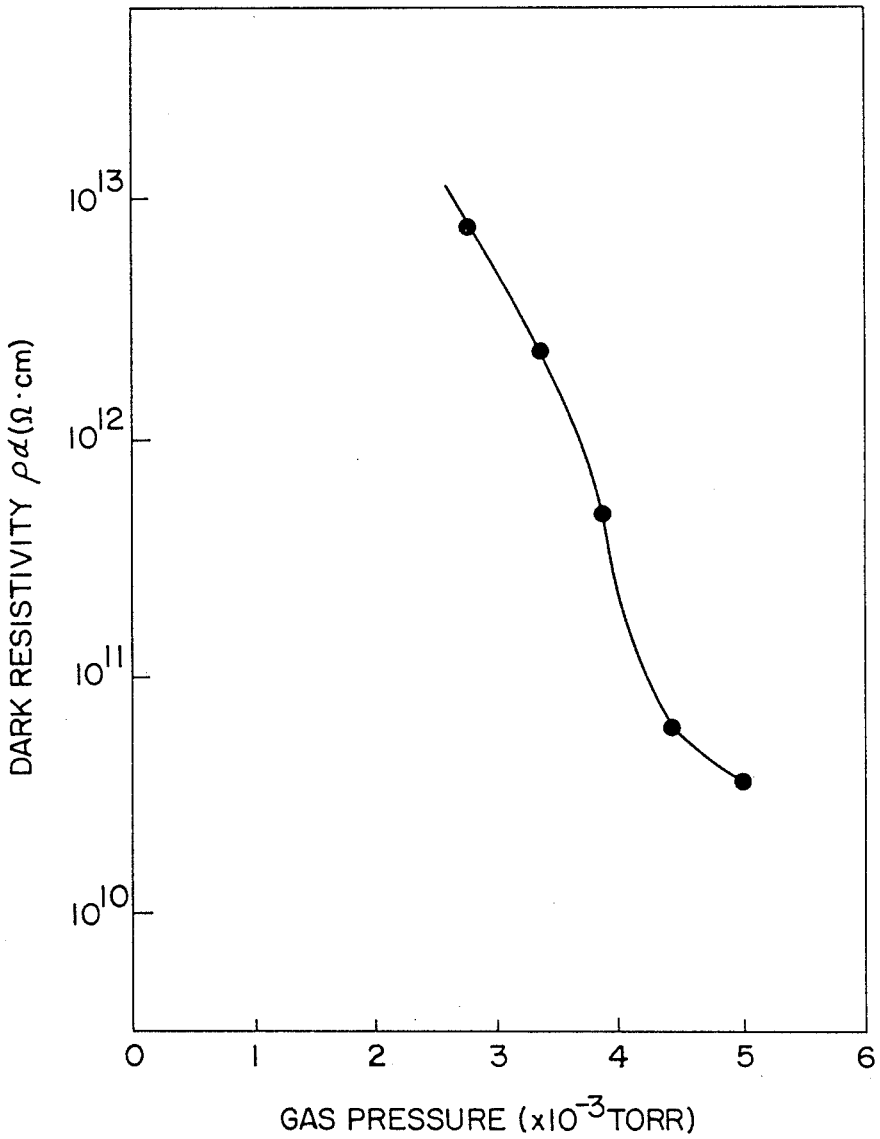
FIG. 6 shows the relationship between the pressure of gas and the dark resistivity ($\rho\delta$) of the a-Si layers of various electrophotographic photosensitive members.

As can be seen from Table 2 above, satisfactory results were obtained when the ratio $\alpha(SiH_2)/\alpha(SiH)$ was set to 1.3–2.5 by controlling the gas pressure to $2.8\times10^{-3}$–$3.4\times10^{-3}$ Torr (according to the relationship shown in FIG. 4).

The amount of hydrogen contained in the photoconductive layer was measured for each photosensitive member. The results were that when the gas pressure was $2.8\times10^{-3}$–$3.4\times10^{-3}$ Torr, 45–52 atomic % of hydrogen was contained in the photoconductive layer and when the gas pressure was $3.8\times10^{-3}$–$5.0\times10^{-3}$ Torr, 20–30 atomic % of hydrogen was contained in the photosensitive layer.

EXAMPLE 3

A photosensitive member to be negatively charged as shown in FIG. 1 was produced in a similar manner to that of Example 1, except that an a-Si layer doped with a small amount of phosphorus was used as the photoconductive layer 4 and an a-Si layer doped with a great amount of phosphorus was used as the intermediate layer 3. As an additional gas for doping phosphorus in the a-Si layers, a gas of a compound of phosphorus with hydrogen or halogen such as $PH_3$, $PCl_3$, or $PCl_5$ is preferred. In place of phosphorus, an element of Group VA or Group VIA of the Periodic Table such as nitrogen, antimony, oxygen or the like can be used. The conditions for the production of respective layers are shown in Table 3 below.

TABLE 3

| Layer | MW power (kW) | Flow rate $SiH_4$ (SCCM) | Flow rate $PH_3$ (SCCM) | $CH_4$ (SLM) | Gas pressure ($\times 10^{-3}$ Torr) |
|---|---|---|---|---|---|
| Intermediate | 2.5 | 120 | 10*1 | — | 2.8 |
| Photoconductive | 2.5 | 120 | 1*2 | — | 2.8 |
| Outer coating | 2.5 | 30 | — | 2.0 | 2.8 |

*1: 3000 ppm in $H_2$.
*2: 30 ppm in $H_2$.

In this example, powdered polymer such as $(SiH_2)_n$ was not produced, and both the deposition rate and the gas availability were much higher than those obtained following the conventional processes. Furthermore, when the resulting a-Si type photosensitive member was examined for its properties, its electric-charge retaining property was particularly excellent. When the a-Si type photosensitive member was used in a commercial copying machine to carry out copying, images of high quality were obtained.

When an a-SiN layer or a-SiO layer formed by the electron cyclotron resonance method was used as the outer coating layer 5 instead of the a-SiC layer, the results obtained were also satisfactory.

EXAMPLE 4

In this example, an electrophotographic photosensitive member 1 as shown in FIG. 1 was produced as follows: On a conductive substrate 2 an intermediate layer 3 made of a-SiN in which a large amount of boron was doped, a photoconductive layer 4 made of a-Si in which a small amount of boron was doped, and an outer coating layer 5 made of a-SiC were successively formed in that order by the electron cyclotron resonance method. The a-Si layer of the resulting photosensitive member 1 was of p-type. The conditions for the production of respective layers are shown in Table 4 below.

TABLE 4

| Layer*1 | MW power (kW) | Flow rate $SiH_4$ (SCCM) | Flow rate $B_2H_6$ (SCCM) | NO (SCCM) | $CH_4$ (SCCM) | Gas pressure ($\times 10^{-3}$ Torr) |
|---|---|---|---|---|---|---|
| Intermediate | 2.5 | 120 | 22*2 | 12 | — | 2.7 |
| Photosensitive | 2.5 | 120 | 6*3 | — | — | 2.7 |
| Outer | 1.5 | 120 | — | — | 18 | 0.8 |

TABLE 4-continued

| Layer*1 | MW power (kW) | Flow rate $SiH_4$ (SCCM) | Flow rate $B_2H_6$ (SCCM) | NO (SCCM) | $CH_4$ (SCCM) | Gas pressure ($\times 10^{-3}$ Torr) |
|---|---|---|---|---|---|---|
| coating | | | | | | |

*1: The substrate was at room temperature.
*2: 3000 ppm in $H_2$.
*3: 30 ppm in $H_2$.

In this example, electrophotographic photosensitive members with different integrated intensity ratios ($I_2/I_1$) in the infrared spectra were also produced in the same way as above. FIG. 7 shows the relationship between the integrated absorption intensity ratio ($I_2/I_1$) and the electric conductivity, and the relationship between the integrated absorption intensity ratio ($I_2/I_1$) and the photo conductivity. Table 5 shows four other properties of the a-Si type photosensitive members A–D with different integrated absorption intensity ratios and the conventional a-Si type photosensitive member E produced by plasma CVD method.

TABLE 5

| Sample | A | B | C | D | E |
|---|---|---|---|---|---|
| Surface Potential (V) | 870 | 860 | 860 | 800 | 820 |
| Percentage of electric charge remaining 1 second after charging (%) | 89 | 89 | 88 | 83 | 79 |
| Sensitivity ($cm^2$/erg) | 0.1 | 0.42 | 0.44 | 0.23 | 0.45 |
| Residual Potential (V) | 210 | 50 | 45 | 105 | 35 |

The a-Si type photosensitive members B and C with the integrated absorption intensity ratios in the range of 0.2–0.6 have excellent sensitivities and the improved electric-charge retaining property compared with the conventional a-Si type photosensitive member E. The image formation was conducted by use of these a-Si type photosensitive members B and C, so that images of high quality free from fog were obtained. Table 5 also indicates that, although the a-Si type photosensitive members A and D with the integrated absorption intensity ratios outside the range of 0.2–0.6 have the improved electric-charge retaining property, their sensitivities and residual potentials are unsatisfactory, so that these photosensitive members are not suitable for practical use.

The a-Si layers with the integrated absorption intensity ratio in the range of 0.2–0.3 were quantitatively analyzed, and it was found that the amounts of hydrogen contained in the a-Si layers were 40–50 atomic %. When the a-Si layer contained hydrogen at a percentage in this range, the dark resistivity and photo conductivity of the photosensitive member were particularly satisfactory.

It is understood that various other modifications will be apparent to and can be readily made by those skilled in the art without departing from the scope and spirit of this invention. Accordingly, it is not intended that the scope of the description as set forth herein, but rather that the claims be construed as encompassing all the features of patentable novelty that reside in the present invention, including all features that would be treated as equivalents thereof by those skilled in the art to which this invention pertains.

What is claimed is:

1. An amorphous silicon photosensitive member for use in electrophotography comprising an electrically conductive substrate and a photoconductive layer formed on said substrate, wherein said photoconductive layer is made of amorphous silicon formed by an electron cyclotron resonance method, said amorphous silicon containing more than 40 atomic % of hydrogen or halogen.

2. An amorphous silicon photosensitive member according to claim 1, wherein said photosensitive layer is made of amorphous silicon containing from more than 40 to 60 atomic % of hydrogen or halogen.

3. An amorphous silicon photosensitive member according to claim 2, wherein said photosensitive layer is made of amorphous silicon containing from more than 40 to 50 atomic % of hydrogen or halogen.

4. An amorphous silicon photosensitive member according to claim 1, wherein the ratio of the absorption coefficient at around 2,100 $cm^{-1}$ the absorption coefficient at around 2,000 $cm^{-1}$ of said amorphous silicon is in the range of from 1.3 to 2.5.

5. An amorphous silicon photosensitive member according to claim 1, wherein the ratio of the integrated absorption intensity at around 840 $cm^{-1}$ to the integrated absorption intensity at around 880 $cm^{-1}$ in the infrared spectrum of said amorphous silicon is in the range of from 0.2 to 0.6.

6. An amorphous silicon photosensitive member according to claim 1, further comprising an intermediate layer interposed between the substrate and the photoconductive layer and an outer coating layer formed on said photoconductive layer.

7. An amorphous silicon photosensitive member according to claim 1, wherein said photoconductive layer is doped with an element of Group IIIA of the Periodic Table as an impurity.

8. An amorphous silicon photosensitive member according to claim 1, wherein said photoconductive layer is doped with an element of Group VA or Group VIA of the Periodic Table as an impurity.

* * * * *